US008028409B2

(12) United States Patent
Hanes

(10) Patent No.: US 8,028,409 B2
(45) Date of Patent: Oct. 4, 2011

(54) METHOD OF FABRICATING PLANAR SPRING CLEARANCE SEAL COMPRESSORS

(75) Inventor: Mark Hanes, Goleta, CA (US)

(73) Assignee: Mark Hanes, Goleta, CA (US)

( * ) Notice: Subject to any disclaimer, the term of this patent is extended or adjusted under 35 U.S.C. 154(b) by 1375 days.

(21) Appl. No.: 11/507,815

(22) Filed: Aug. 21, 2006

(65) Prior Publication Data

US 2007/0157801 A1 Jul. 12, 2007

Related U.S. Application Data

(60) Provisional application No. 60/595,948, filed on Aug. 19, 2005.

(51) Int. Cl.
*B23P 15/00* (2006.01)

(52) U.S. Cl. ..... 29/888.02; 29/898.02; 29/898.09; 29/446; 60/520; 417/53; 417/44.1; 417/413.1; 417/415; 417/45

(58) Field of Classification Search ..... 29/888.02, 29/898.02, 898.09, 446; 60/6, 520, 517; 417/53, 413.1, 415, 44.1, 45; 546/859
See application file for complete search history.

(56) References Cited

U.S. PATENT DOCUMENTS 4,350,012 A * 9/1982 Folsom et al. ..... 60/520
5,525,845 A 6/1996 Beale et al.
6,293,184 B1 9/2001 Unger
6,514,047 B2 * 2/2003 Burr et al. ..... 417/53
2005/0022662 A1 2/2005 Wiseman et al.

FOREIGN PATENT DOCUMENTS

EP 1 450 472 A1 8/2004
WO WO-2006/069883 A1 7/2006

OTHER PUBLICATIONS

International Search Report and Written Opinion of the International Searching Authority Dated Oct. 26, 2007, International Application No. PCT/US2007/005356.

* cited by examiner

*Primary Examiner* — Richard Chang
(74) *Attorney, Agent, or Firm* — Blakely Sokoloff Taylor & Zafman LLP

(57) ABSTRACT

In accordance with the method, a gas bearing is energized to center the piston in the cylinder prior to rigidly attaching the planar spring or springs between the piston and the compressor frame. This automatically and very accurately centers the piston in the cylinder to provide the added stiffness of a planar spring and gas bearing in an easily manufactured configuration. Various exemplary embodiments are disclosed, including embodiments having the piston cantilevered from one end using a single or multiple springs, an embodiment having a spring on each end of the piston, a double piston embodiment and embodiments using and not using the gas bearing during operation of the compressors.

21 Claims, 11 Drawing Sheets

METHOD OF FABRICATING PLANAR SPRING CLEARANCE SEAL COMPRESSORS

CROSS-REFERENCE TO RELATED APPLICATION

This application claims the benefit of U.S. Provisional Patent Application No. 60/595,948 filed Aug. 19, 2005.

BACKGROUND OF THE INVENTION

1. Field of the Invention

This innovation pertains to compressors utilizing linear motor drive and clearance seals. These compressors utilize a linear motor to drive the piston and a spring to provide energy storage to create a mechanical resonant moving mass (piston assembly) and axial restoring force to properly locate the piston.

2. Prior Art

The typical gas bearing compressor system utilizes a piston that is allowed to move radially with little resistance, which in turn allows the gas bearing to center the piston in the cylinder and prevent piston to cylinder contact. This type of gas bearing system is described in patent U.S. Pat. Nos. 6,293,184 and 5,525,845. Another method for preventing piston to cylinder contact is to use a "planar spring" supported piston. This system utilizes flat springs to provide a very stiff radial spring constant that will guide the piston and prevent contact with the cylinder. A key difficulty of this latter design is obtaining proper alignment while securing the springs. The typical radial gap between piston and cylinder in these oil free clearance seals is 0.0001 to 0.0003 inches. This mechanical alignment approach requires expensive precise tooling and significant labor costs, and is hence incompatible with a low cost, mass produced device. If this alignment is not correct, the springs, which are very stiff in the radial direction, will force the piston against the cylinder and cause premature wear and failure.

DETAILED DESCRIPTION OF THE PREFERRED EMBODIMENTS

Figure 1:
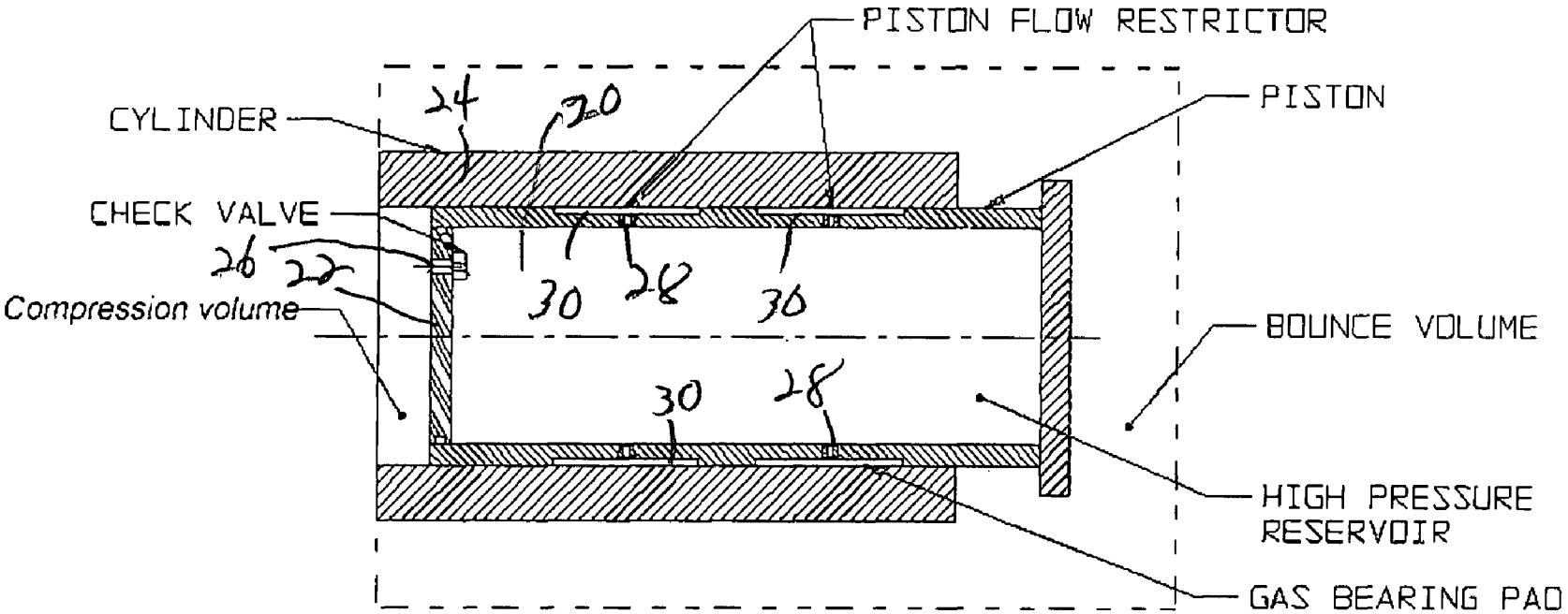
FIG. 1 is a schematic illustration of a typical gas bearing implementation of a compressor utilizing clearance seals and incorporating an embodiment of the present invention.

This disclosure describes a technique and configuration for hybrid gas bearing, planar spring clearance seal compressors that provides an elegant combination of a precisely aligned and radially stiff spring along with a gas bearing which in combination accurately center the piston in the cylinder bore. This combination is in effect a hybrid planar spring supported/gas bearing supported piston. This approach is an improvement over prior art in that it is significantly easier to manufacture than a piston supported by a planar spring only, and combines the added stiffness of a planar spring to the gas bearing in an easily manufactured configuration.

The key to realizing this in a practical implementation is to use the gas bearing to accurately align the planar spring during assembly and alignment of the planar spring. The gas bearing will precisely center the piston in the cylinder when activated. This is accomplished by pressurizing the gas bearing input during assembly from an external source of gas (filtered air or other gas) under pressure. The bearing will precisely center the piston, overcoming any gravitational, magnetic or other loading from the assembly fixtures that would otherwise misalign the piston.

This is accomplished during the assembly procedure. In an embodiment having a self priming gas reservoir in the piston, such as in a piston/cylinder combination as shown in the cross section of FIG. 1, the gas bearing reservoir 20 is pressurized to some high value, which will "energize" the gas bearings and precisely center the piston 22 in the cylinder 24. This approach also provides the option of using an arbitrarily high pressure to achieve optimal centering force for the assembly process. While the gas bearings are energized, the piston spring will be attached to its mounting surface, resulting in a accurately located piston. Typically the rear of the piston will be supported by the spring (not shown in FIG. 1) and the front by the gas bearings. The reservoir 20 can be pressurized through the check valve 26, or through a port specifically designed for that purpose only.

In summary, the present invention uses a gas bearing to provide the centering force necessary to insure the piston is in the proper location when the planar spring is attached to its mounting surfaces relative to the piston and the cylinder, thus ensuring proper alignment of the piston relative to the cylinder. In effect this is a built in alignment tool.

The following is a description of a typical gas bearing, planar spring clearance seal compressor, in this case with the reservoir 20 and flow restrictors 28 for the gas bearings located in the piston, though this is only one of several possible configurations, as shall subsequently be seen. The gas bearings eliminate virtually all contact between the compressor piston 22 and the compressor cylinder 24, hence eliminating friction and wear. The piston has a slight clearance with the cylinder 24 as previously quantified. During compressor operation, the high pressure reservoir is kept at a relatively constant and elevated pressure by the action of the check valve 28. During the portion of the cycle where the working pressure in the compression end of the compressor is higher than the pressure of the high pressure reservoir, gas flows from the compression end into the reservoir 20 and "recharges" it. During the time when the compression end pressure is lower than the reservoir pressure, the check valve 28 is closed, preventing gas from escaping from the reservoir 20. During the entire cycle, gas is flowing from the reservoir 20 through the piston flow restrictors 28 and into the bounce volume (assuming one end of the cylinder is sealed).

Figure 2:
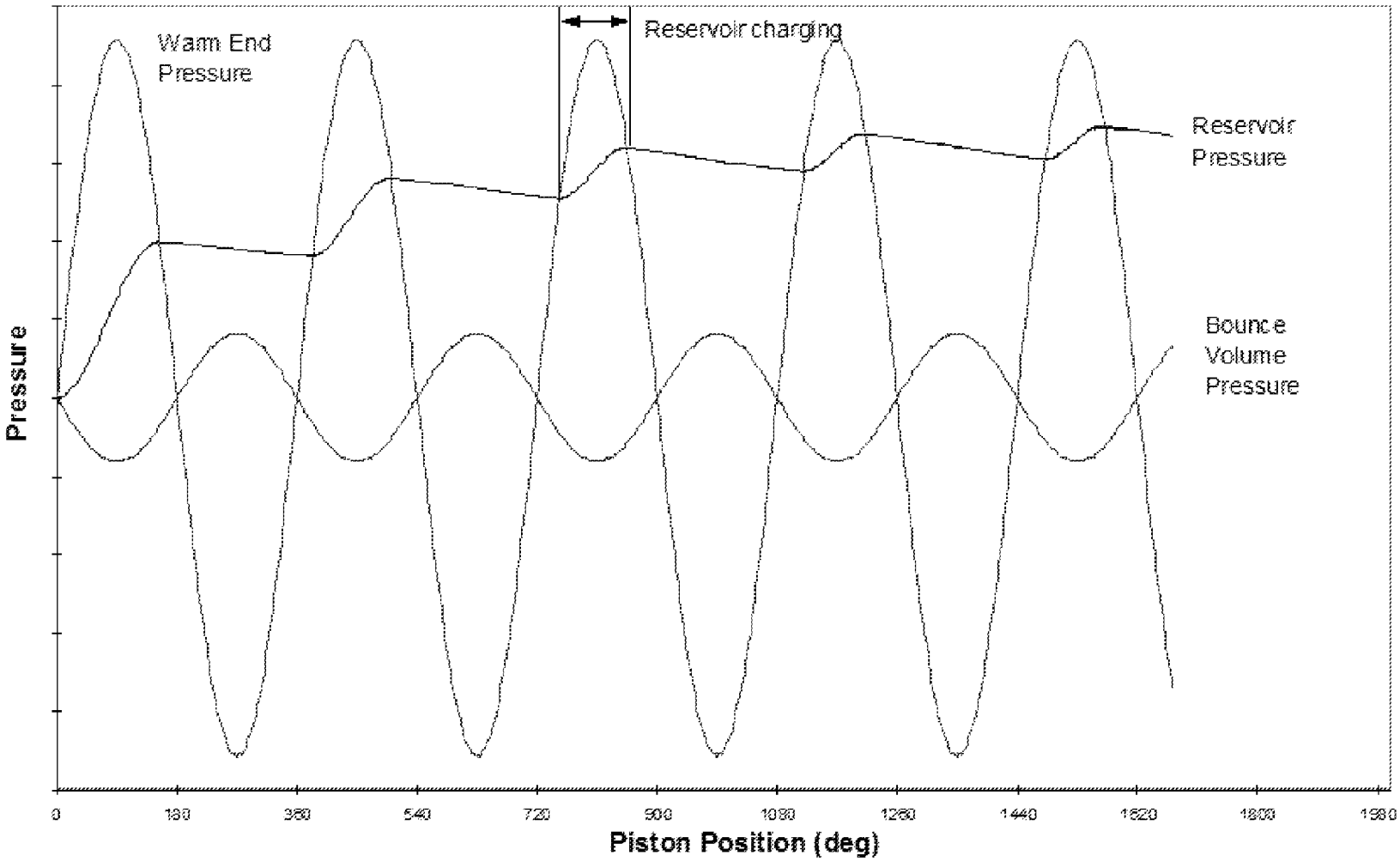
FIG. 2 is a graph illustrating the pressures in various volumes in the compressor of FIG. 1.

The three pressures within the system of FIG. 1 are shown in FIG. 2.

As shown on the graph, all the pressures initially start at the same level. As the compressor begins to run, the pressure in the reservoir 20 begins to pump up to an almost constant level. The magnitude of the fluctuation in the reservoir pressure is a function of the reservoir volume and the piston gas bearing flow restrictor flow rates. Therefore, if these parameters are designed correctly, the gas bearing will operate over an almost constant pressure difference, in spite of the oscillatory nature of the pressure in the compression end, or working, volume of the compressor.

Figure 3:
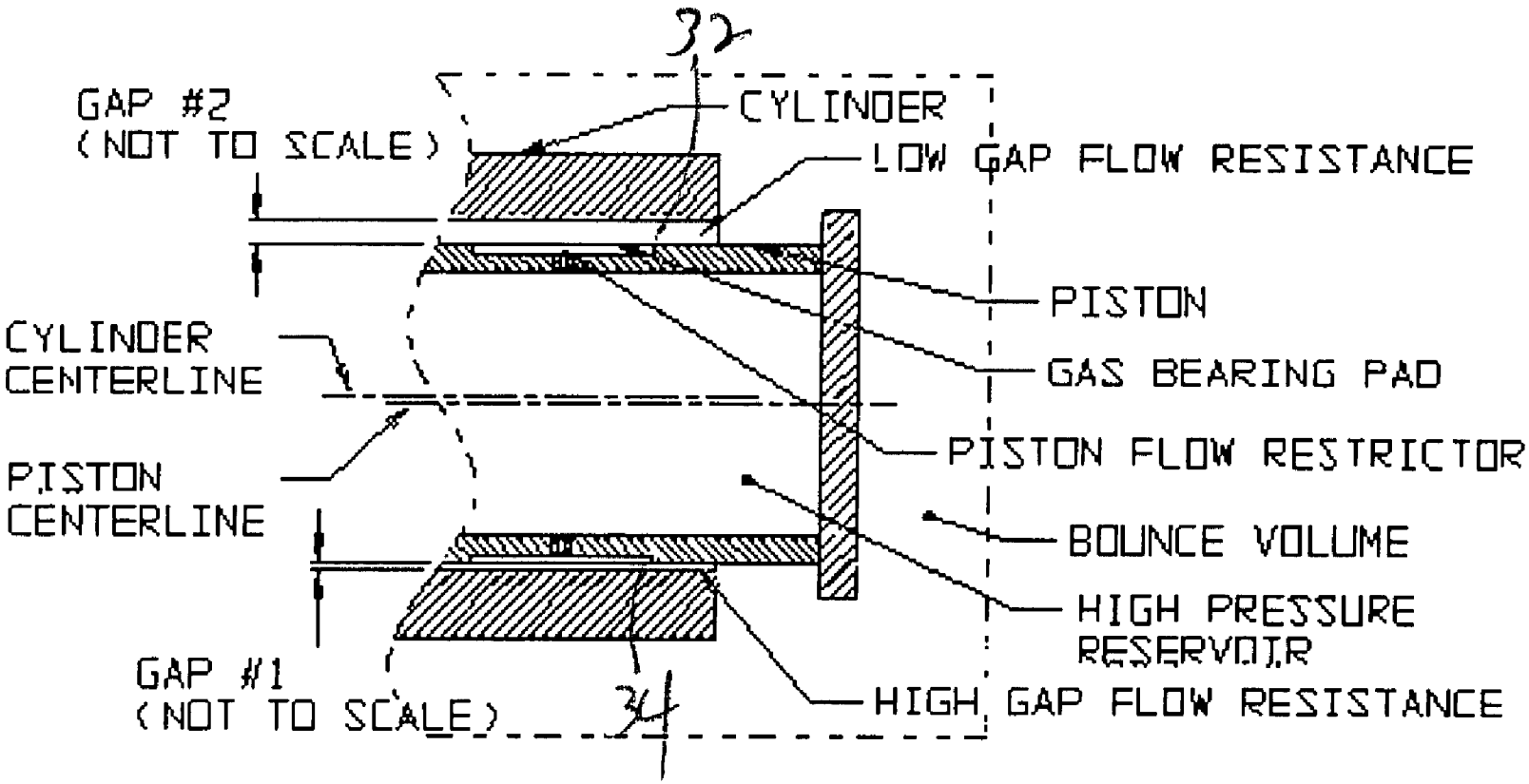
FIG. 3 illustrates a compressor gas bearing with the piston being located off axis.

FIG. 3 shows an expanded piston-cylinder gap to illustrate the principles of a gas bearing supported piston. The piston 22 which is supported by the gas bearing will have a flow resistance of the piston flow restrictors chosen to approximately equal the flow resistance of the annular gap between the piston and the cylinder when the piston is centered in the cylinder. This results in the pressure in the gas bearing pads 30 being approximately halfway between the reservoir and the bounce volume pressures. Also, when the piston is centered, the pressures in the pads are equal on all sides of the piston, and there are no net gas bearing forces acting on the piston. However, when the piston is forced off center, as depicted in FIG. 3, the gas flow resistance of gap 32 becomes lower than that of gap 34, which increases, and the pressure in the gas bearing pad associated with gap 34 increases (becomes more closely coupled to the higher pressure reservoir), while at the same time the pressure in pad 32 on the opposite side decreases (becomes more closely coupled to the lower pressure bounce volume). This results in a pressure difference between the two sides of the piston that acts upon the projected area of the piston to provide a centering force. Since the flow resistance of the gap is proportional to the inverse of the gap width cubed, large pressure differences will exist for very small piston offsets. In the prior art, such gas bearings have been used to center a relatively non-rigidly mounted piston within and operating compressor, but not to center a relatively rigidly mounted piston during manufacture of the compressor.

Figure 4:
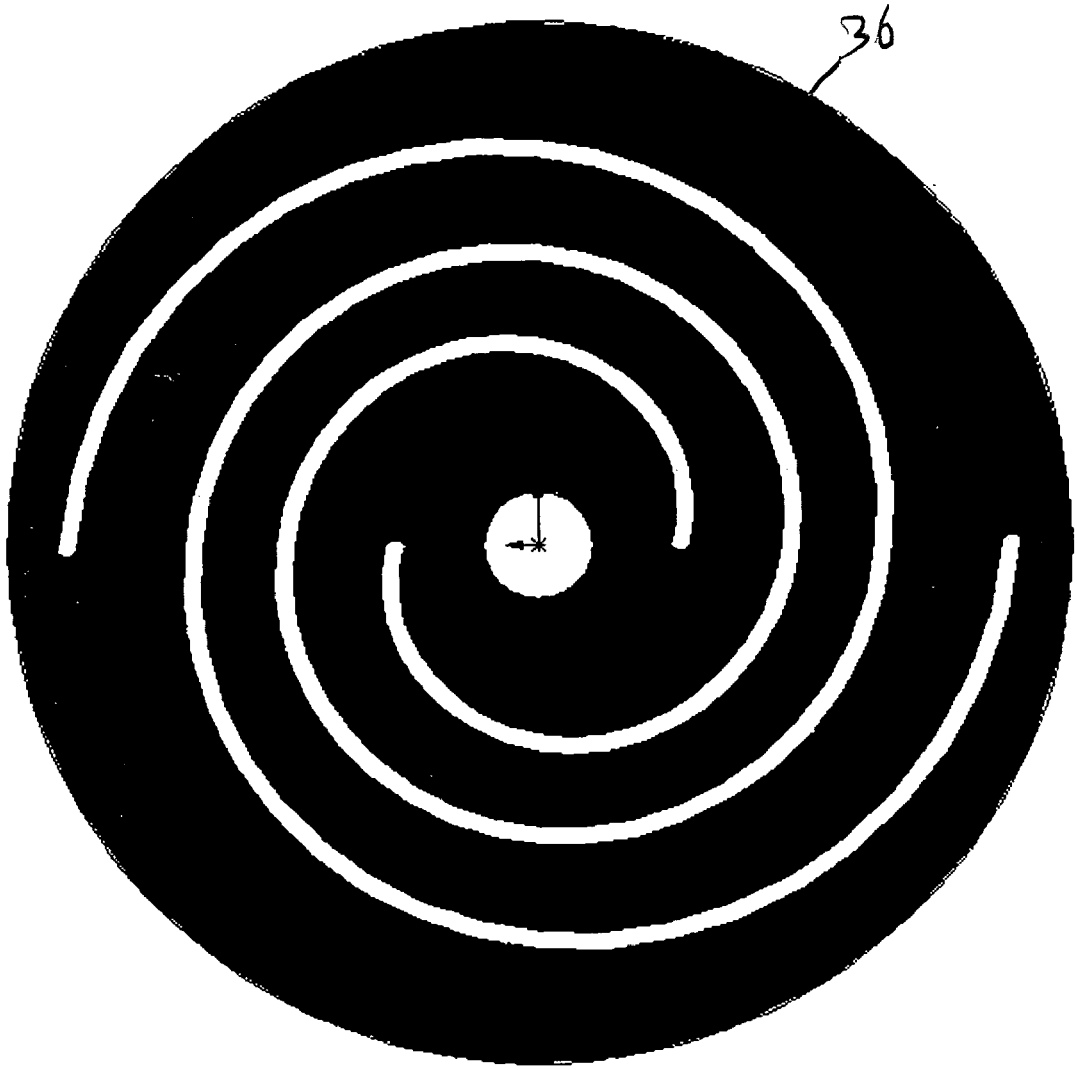
FIGS. 4, 5 and 6 are illustrations showing a face view of one typical planar spring fabricated from sheet metal.
Figure 5:
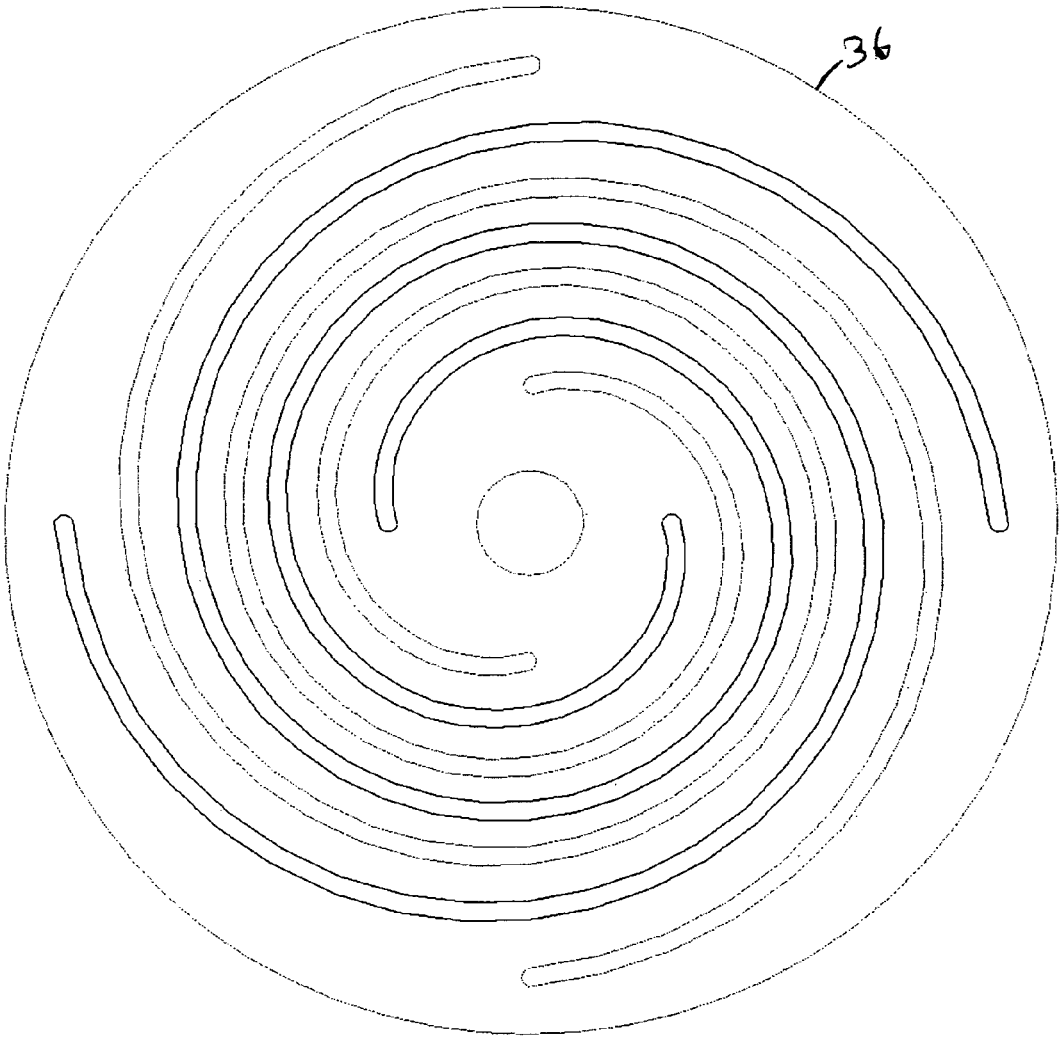
Figure 6:
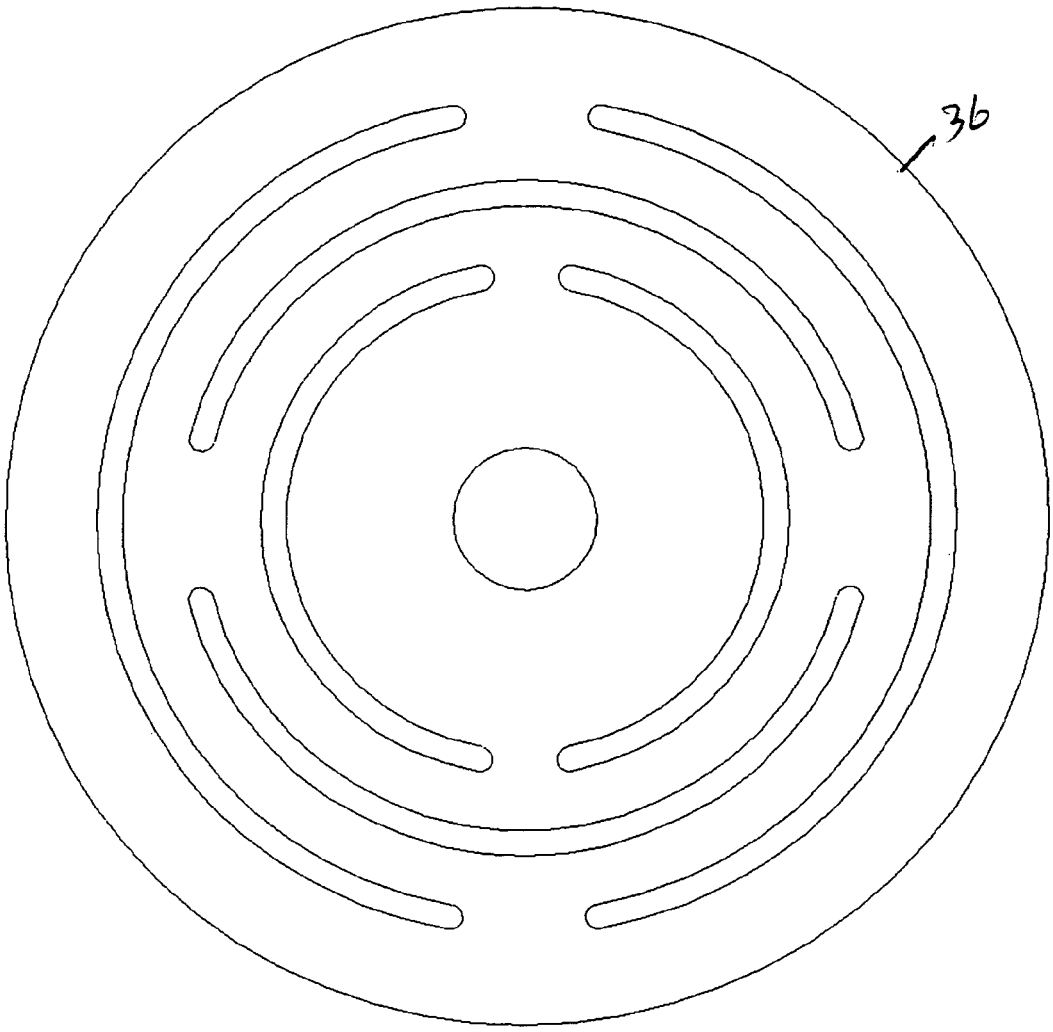

The approach disclosed in the present invention combines the benefits of the gas bearing with planar springs. FIGS. 4, 5 and 6 illustrate typical planar springs 36 fabricated from ~½ to 1.5 mm thick metal. These planar springs, as well as other suitable designs, generally provide a basic symmetry in the spring configuration, so that any tendency of one spring member to want to deflect in a slight arc rather straight along the cylinder axis is balanced by a complementary spring member providing an opposite tendency.

Figure 7:
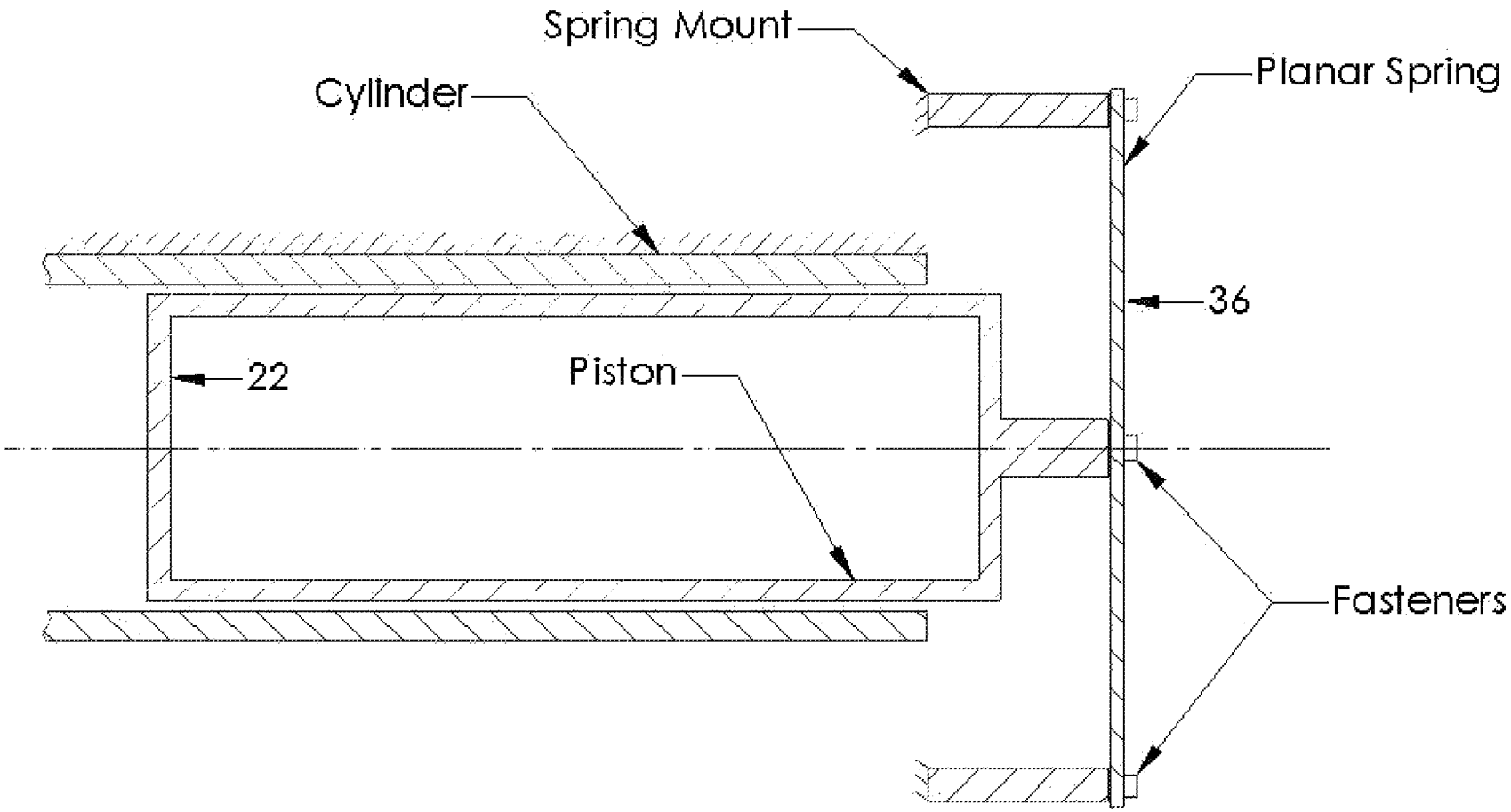
FIG. 7 illustrates one possible configuration of gas bearing and planar spring hybrid useable with the present invention.

One possible configuration of the combined gas bearing (not shown in detail) and planar spring 36 is illustrated schematically in FIG. 7. FIG. 7 is a cross-section illustrating the rigid mounting of the planar spring 36 to the piston 22 and the spring mount to the housing to which the cylinder is also rigidly mounted.

Figure 8:
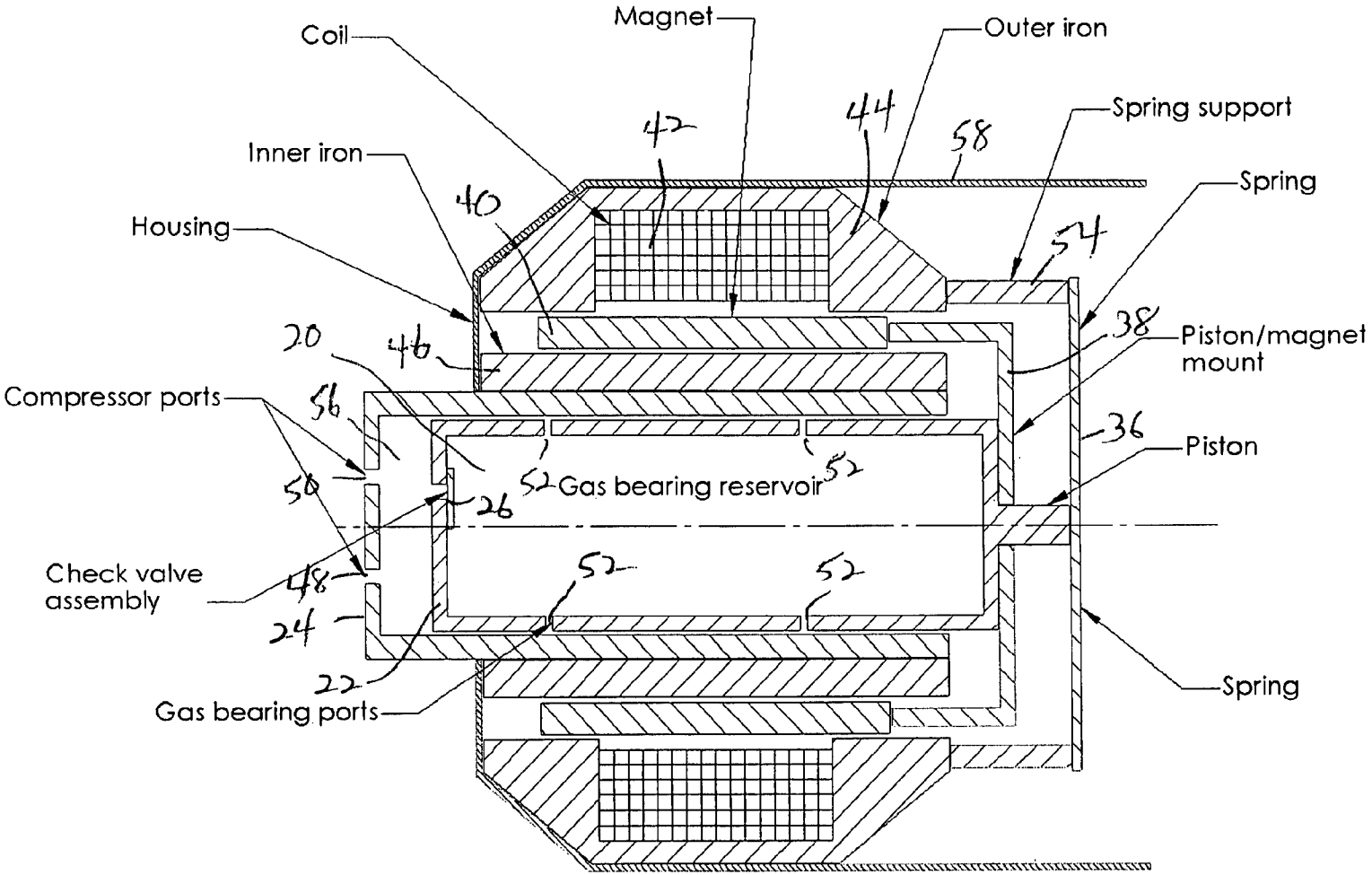
FIGS. 8, 9, 10 and 11 illustrate exemplary compressor embodiments that may be fabricated using the present invention.

Now referring to FIG. 8, a schematic cross-section of a complete compressor generally in accordance with FIGS. 1 through 3 may be seen. The piston 22 within cylinder 24 has a permanent magnet mount 38 supporting a radially magnetized permanent magnet 40 disposed in the field created by coil 42 in the magnetic circuit formed by outer and inner soft iron magnetic circuit pieces 44 and 46. In operation, an alternating current in coil 42 will cause an alternating axial force on piston 22. In this type of compressor, the piston 22 has a gas bearing reservoir 20 with a one-way valve 26, allowing the reservoir to be pressurized by the operation of the compressor, the compressor ports 48 and 50 typically not having check valves. The reservoir 20 operates as shown in FIG. 2 to provide pressure for the gas bearing ports 52 (details of the gas bearing not be shown for clarity).

In the compressor shown in FIG. 8, the planar spring 36 is rigidly mounted to the piston 22, as well as to the spring support 54. Prior to rigidly connecting the planar spring 36 to both the spring support 54 and the piston 22, in accordance with the present invention, the gas bearing reservoir 20 is pressurized to activate the gas bearings to center the piston 22 in cylinder 24. Then planar spring 36 is rigidly coupled in position. In that regard, planar spring 36 may be rigidly coupled to one of its attachment members, typically the spring support 54, before pressurizing the gas bearing reservoir 20, though the final connection of planar spring 36, typically to the piston 22, will occur after pressurizing the bearing. In that regard, it should be noted that typically as shown, at least two sets of axially spaced apart gas bearings are provided so as to provide gas bearing centering forces at two spaced apart locations along the piston, to both center the piston in the cylinder and to align the axis of the piston with the axis of the cylinder. The final attachment, such as by way of example the attachment of the piston 22 to the planar spring 36 in this and other embodiments, may be by any suitable technique, such as by way of example, by one or more screws, by cement such as an epoxy, or by both. In that regard, initially fastening the final attachment point or points by cement, even if later backed up with one or more screws or other fasteners, has the advantage of creating a rigid attachment without imparting any substantial forces on the spring or on the piston while the attachment is being made, thereby assuring that the free state of the piston is centered.

Pressurizing the gas bearing reservoir 20 may be accomplished in any of various ways. Pressurizing region 56 through inlet and outlet ports 48 and 50 has the disadvantage of providing an axial force on the piston 22, though the gas bearings will still exhaust through the right end of the assembly, magnet support 38 having various openings therein to allow gas flow from the gas bearings through the openings in the magnet support 38 and through planar spring 36. One can avoid this axial force by making a connection to the port of check valve 26 through one of the inlet or outlet ports for the compressor. The gas bearing reservoir 20 might also be pressurized by providing a port especially configured for this purpose at the right end of piston 22 that may be then sealed after the piston is centered in the cylinder and planar spring 36 is rigidly attached for subsequent operation of the compressor. In that regard, the various forms of the word "rigid" as used herein are used in a relative sense in comparison to the planar spring 36. For example, in the embodiment of FIG. 8, the planar spring will exhibit some radial spring rate that preferably for the present invention will be relatively high. However the attachment of the piston to the planar spring shall be considered rigid if the radial spring rate of that attachment is even higher, preferably at least 10 times higher, than the radial spring rate of the planar spring. Similarly, because the piston 22 is cantilevered off of the planar spring in the embodiment of FIG. 8, the attachment-point will be considered rigid if the spring rate of the rigid attachment of the piston to the planar spring 36 about any axis in or parallel to the plane of the planar spring 36 is at least higher than the corresponding spring rate of the planar spring itself, and again more preferably, at least 10 times the corresponding spring rate of the planar spring.

Figure 9:
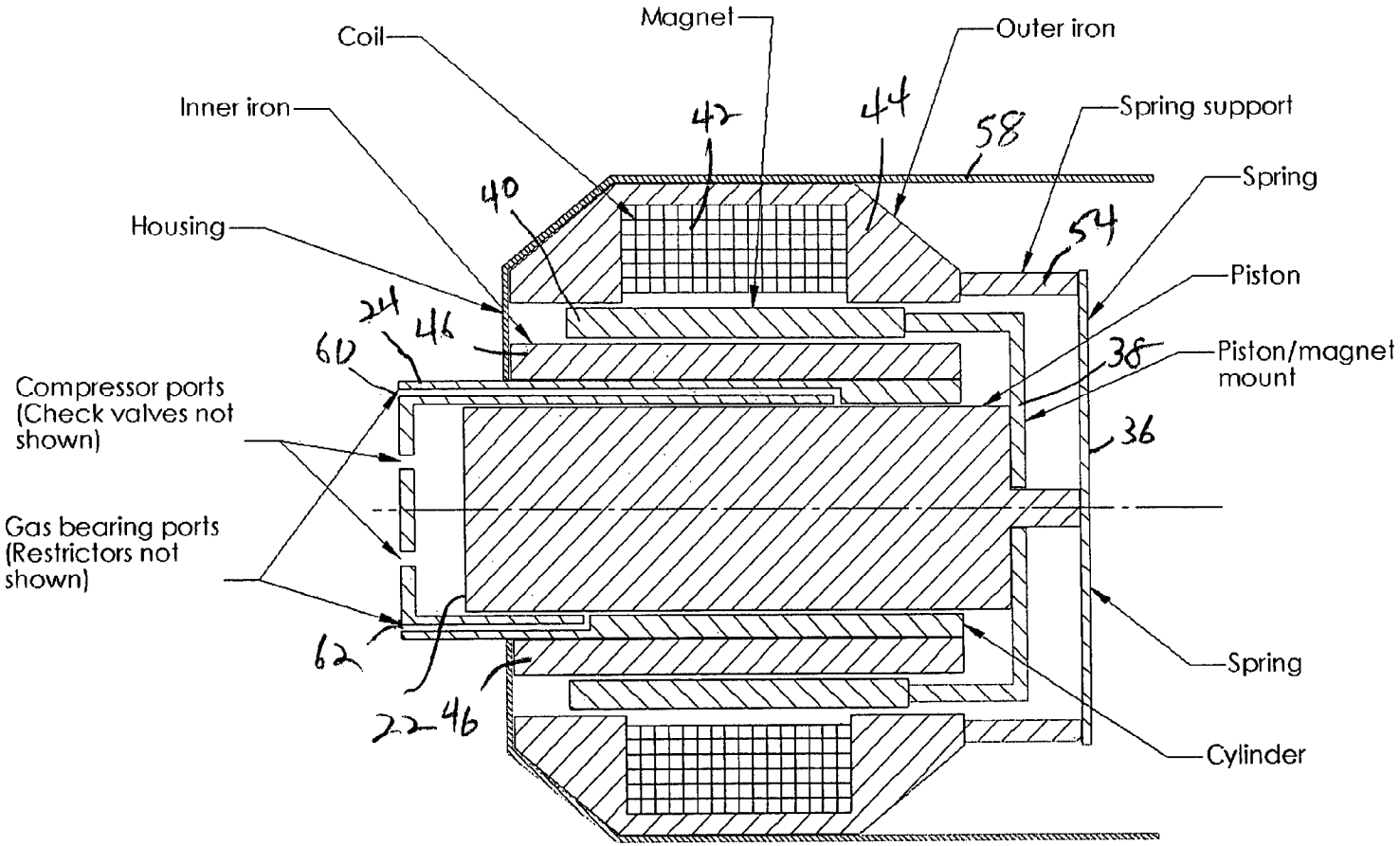

FIG. 9 shows an embodiment generally similar in construction to the embodiment of FIG. 8, though with a solid piston 22 rather than a piston with a reservoir as in FIG. 8. In this case, ports 60 and 62 are each provided to pressurize a respective gas bearing, typically for individual gas bearings in at least three circumferential positions around the piston 22. Note that while the gas bearing inlet ports 60 and 62, as well as the flow restrictors (not shown), in such an embodiment will be in the cylinder, the pads for the gas bearings themselves (see pads 30 in FIG. 1) may be either on the inner gas wall of the cylinder or on the outer surface of piston 22, provided the stroke of the piston is not excessive. These gas bearings can easily be pressurized for centering and alignment purposes during fabrication in accordance with the present invention, and typically would be pressurized by the output of the compressor during normal operation of the compressor, the compressor ports 48 and 50 typically having check valves for the inlet and exhaust gas of the compressor.

Figure 10:
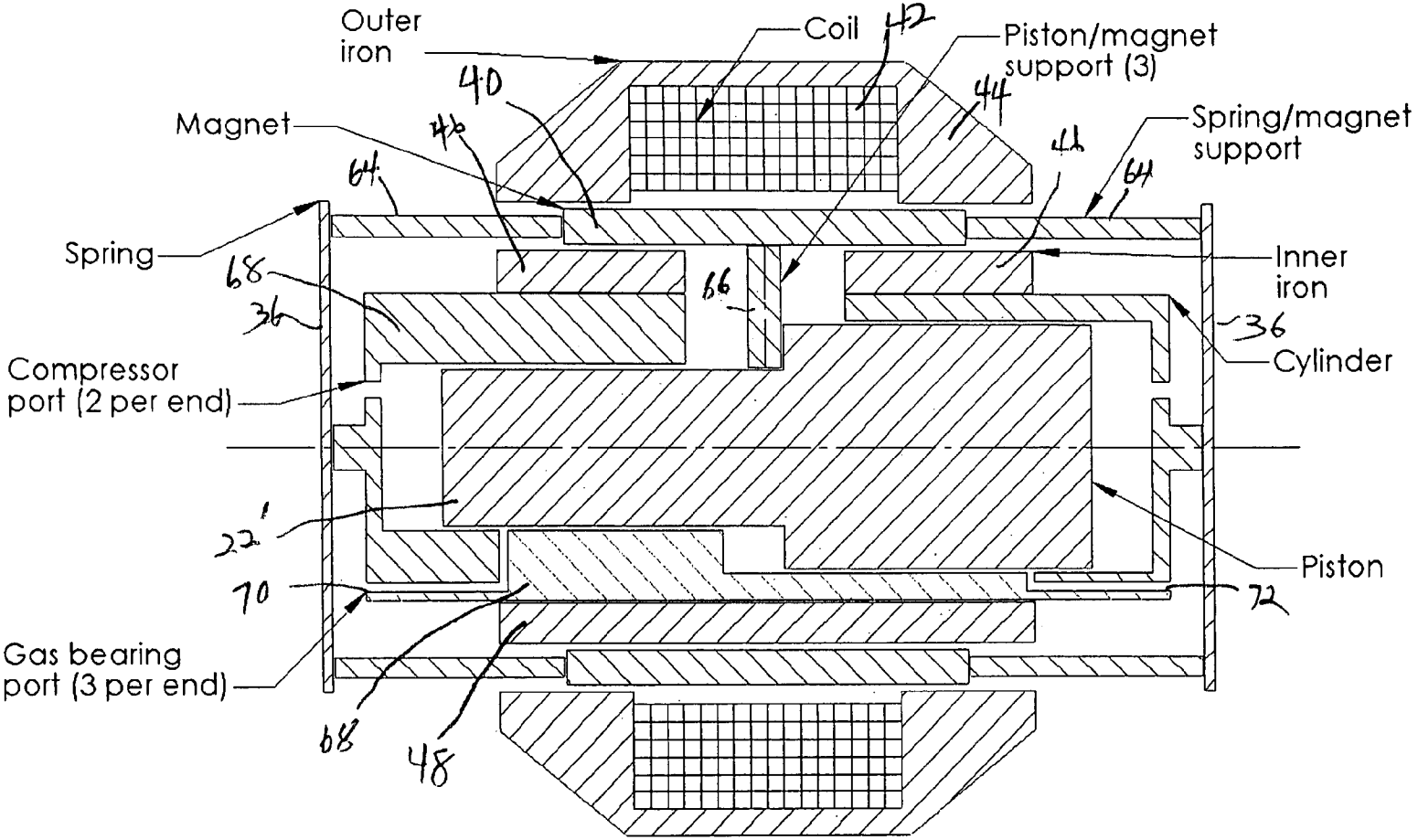

FIG. 10 is a cross-section of a double acting piston compressor utilizing two planar springs 36. In this embodiment, the centers of the two planar springs 36 are connected to the frame of the compressor, and accordingly do not move, but instead the periphery of the planar springs move, being driven through spring supports 64 by magnet 40. A piston/magnet support 66 supports double acting piston 22', fitting within a cylinder at each end of the piston. The piston/magnet support 66 is comprised of local supports, the magnetic member 46 having local openings therein to accommodate the piston/magnet support. Similarly, the two cylinders in this embodiment are actually comprised of a single cylinder member 68, also having local openings therein to accommodate the piston/magnet support 66.

In the embodiment of FIG. 10, the gas bearing ports 70 and 72 are readily accessible from the ends of the assembly for pressurizing prior to rigidly attaching the planar springs 36. In such an embodiment the gas bearing ports may be connected to the compressor output or may be sealed off if the piston support during normal operation of the compressor is to be provided solely by the planar springs themselves.

Figure 11:
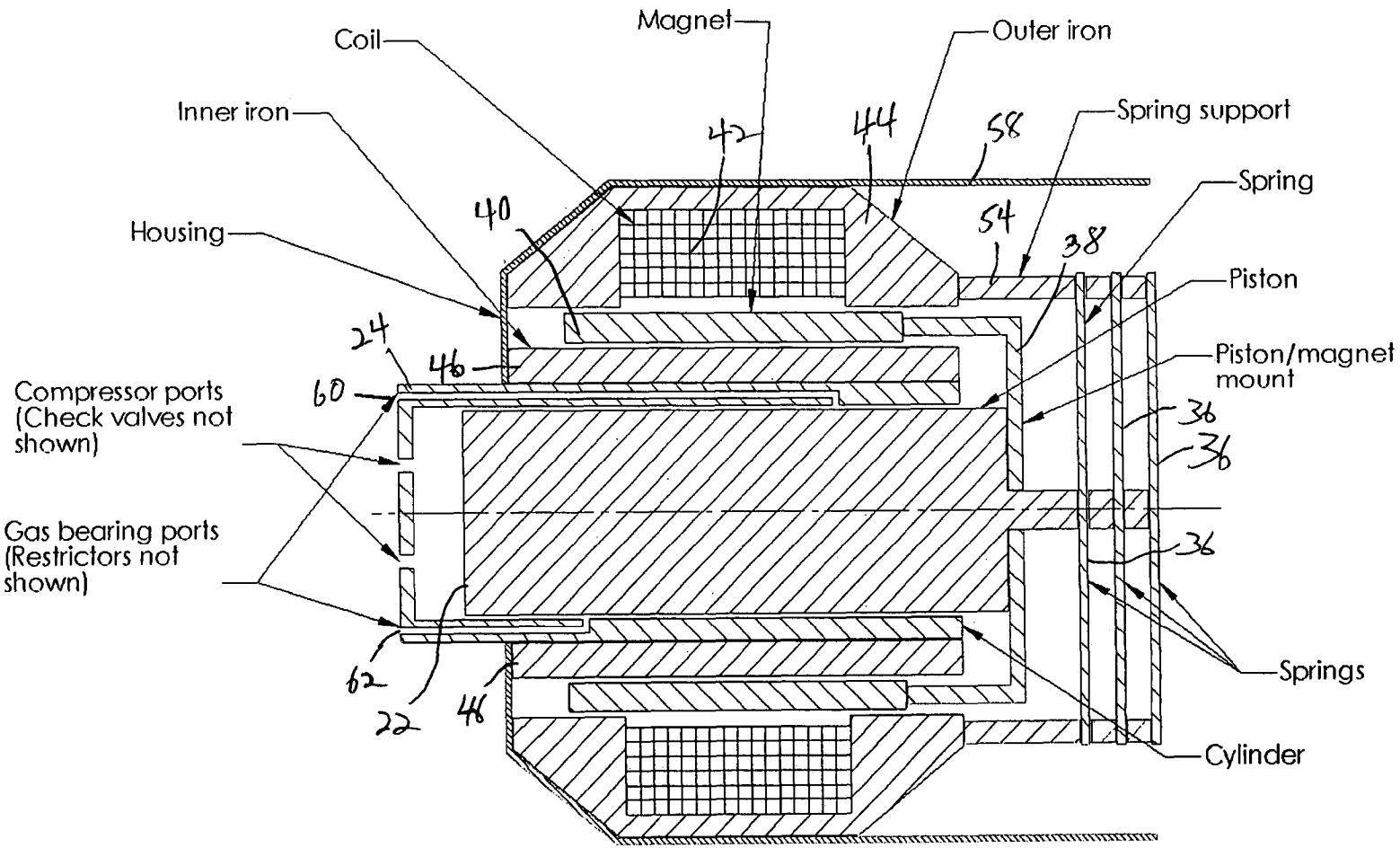

Finally, FIG. 11 is a cross-section of an embodiment similar to that of FIG. 9, but with multiple, spaced apart planar springs supporting one end of the piston. Such a support can maintain clearance between the piston 22 and the cylinder 24 in the presence of reasonable side loads on the piston (gravity or acceleration) even without use of a gas bearing for radial support. However one must first accurately center the piston in the cylinder for final attachment of the planar springs 36, a task for which the present invention is well suited. Pressurizing the gas bearings prior to the final attachment of the planar springs 36 in accordance with the present invention will very accurately center the piston 22 in the cylinder 24 and at the same time very accurately align the axes of the piston and cylinder. The net result is a very low cost centering method, assuring repeatable accuracy in the centering and alignment not readily achieved by other methods. In embodiments like FIG. 11, the gas bearing passageways may be sealed off after the planar springs have been permanently attached. Also, the flow restrictors for the gas bearings may be part of the pressurizing tooling rather that part of the compressor, thereby making their expense a one time tooling expense rather than a per compressor expense.

Thus while certain preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A method of fabricating a planar spring clearance seal compressor comprising:

providing a piston having an outer diameter and a house containing a cylinder having an inner diameter within which the piston is to reciprocate along an axis of the piston;

providing gas bearing pads on one of a) the outer diameter of the piston, b) the inner diameter of the cylinder, or c) pressurizing tooling to center the piston relative to the cylinder in a direction perpendicular to the axis of the piston, the gas bearing pads having associated gas flow passageways and gas flow restrictors;

providing at least one planar spring;

positioning the planar spring perpendicular to the axis of the piston and providing a gas under pressure to the gas flow passageways and gas flow restrictors to center the piston in the cylinder in a direction perpendicular to the axis of the piston before permanently fastening the at least one planar spring to the compressor to fix the relative radial positions of the piston and the cylinder;

while maintaining the gas pressure, rigidly fastening the at least one planar spring so that the planar spring fixes the relative radial position of the piston and the cylinder, the planar spring being fastened to the piston adjacent a center of the planar spring and to the housing adjacent a periphery of the planar spring radially outward from the center of the planar spring; and, terminating the gas pressure to the gas flow passageways and gas flow restrictors.

2. The method of claim 1 wherein a number of planar springs is one and the planar spring is located at a first end of the piston and fixes the relative radial position of the piston and the cylinder adjacent the planar spring.

3. The method of claim 2 wherein the gas bearing pads and the gas flow restrictors are used in an operating compressor to maintain the centering of the piston within the cylinder.

4. The method of claim 3 wherein the gas bearing pads and flow restrictors are on the piston.

5. The method of claim 1 wherein the number of planar springs is two, each being fastened to a respective end of the piston.

6. The method of claim 1 wherein the gas flow passageways in the planar spring clearance seal compressor are sealed after the gas pressure is terminated.

7. The method of claim 6 wherein the piston is a double acting piston.

8. The method of claim 1 wherein a plurality of planar springs are spaced apart and fastened to one end of the piston.

9. The method of claim 8 wherein the gas flow passageways in the planar spring clearance seal compressor are sealed after the gas pressure to the gas flow passageways and gas flow restrictors is terminated.

10. The method of claim 9 wherein the gas flow restrictors are associated with apparatus for providing a gas under pressure to the gas flow passageways and not the planar spring clearance seal compressor.

11. The method claim 1 wherein the planar spring is rigidly fixed relative to one of the piston or cylinder before gas pressure is provided.

12. A method of fabricating a planar spring clearance seal compressor comprising:

providing a piston having an outer diameter and a cylinder in a housing, the cylinder having an inner diameter within which the piston is to reciprocate;

providing gas bearing pads on the outer diameter of the piston distributed around the periphery of the piston or in the inner diameter of the cylinder in at least two spaced apart locations, the gas bearing pads having associated gas flow passageways and gas flow restrictors;

providing a gas under pressure to the gas flow passageways and gas flow restrictors before permanently fastening at least one planar spring to the compressor to fix the relative radial positions of the piston and the cylinder;

while maintaining the gas pressure, rigidly fastening at least one planar spring so that the planar spring fixes the relative radial position of the piston and the cylinder, the planar spring being fastened to the piston adjacent a center of the planar spring and to the housing adjacent a periphery of the planar spring radially outward from the center of the planar spring; and, terminating the gas pressure to the gas flow passageways and gas flow restrictors.

13. The method of claim 12 wherein the number of planar springs is one and the planar spring is located at a first end of the piston and fixes the relative radial position of the piston and the cylinder adjacent the planar spring.

14. The method of claim 12 wherein the gas bearing pads and the gas flow restrictors are used in an operating compressor to maintain the centering of the piston within the cylinder.

15. The method of claim 12 wherein the number of planar springs is two, each being fastened to a respective end of the piston.

16. The method of claim 15 wherein gas flow passageways in the planar spring clearance seal compressor are sealed after the gas pressure is terminated.

17. The method of claim 12 wherein the piston is a double acting piston.

18. The method of claim 12 wherein a plurality of planar springs are spaced apart and fastened to one end of the piston.

19. The method of claim 18 wherein the gas flow passageways are sealed after the gas pressure is terminated.

20. The method of claim 19 wherein the gas flow restrictors are associated with apparatus for providing a gas under pressure to the gas flow passageways and not the planar spring clearance seal compressor.

21. The method claim 12 wherein the planar spring is rigidly fixed relative to one of the piston and cylinder before gas under pressure is provided to the gas flow passageways and the gas flow restrictors.

* * * * *